United States Patent [19]

Wolf

[11] Patent Number: 4,601,504

[45] Date of Patent: Jul. 22, 1986

[54] SAFETY MECHANISM FOR HIGH SECURITY LOCK

[75] Inventor: Ralph C. Wolf, Yorba Linda, Calif.

[73] Assignee: Major Lock, Corp., Anaheim, Calif.

[21] Appl. No.: 603,087

[22] Filed: Apr. 23, 1984

[51] Int. Cl.[4] ..... E05C 1/16

[52] U.S. Cl. ..... 292/334; 292/108

[58] Field of Search ..... 292/334, 335, 332, 333, 292/152, 336

[56] References Cited

U.S. PATENT DOCUMENTS

| | | | |
|---|---|---|---|
| 28,190 | 5/1860 | McEroy | 292/152 X |
| 1,169,429 | 1/1916 | Rothschild | 292/334 |
| 1,548,530 | 8/1925 | Knight | 292/152 |
| 2,575,674 | 11/1951 | Miller | 70/129 |
| 3,912,309 | 10/1975 | Fischer et al. | 292/335 X |
| 4,163,376 | 8/1979 | Miller et al. | 70/303 A |

*Primary Examiner*—Richard E. Moore

*Attorney, Agent, or Firm*—Herb Boswell

[57] ABSTRACT

A high security lock of the type having a base, a bolt which moves on the base and engages a strike, and a dead lock tripper which interacts with the strike to automatically lock the bolt is improved by including a lock prevent member in association with the bolt. The lock prevent member inhibits the bolt from moving from an unlocked to a locked position in spite of the dead lock tripper interacting with the strike. A secondary key can be used to inactivate the lock prevent member such that the lock returns to its normal mode of operation with the interaction of the dead lock tripper and the strike automatically locking the lock.

9 Claims, 6 Drawing Figures

10
12
14
16
18
20
22
24
26
28
30
32
34
36
38
94

SAFETY MECHANISM FOR HIGH SECURITY LOCK

BACKGROUND OF THE INVENTION

In certain high security situations, high security locks of the type which utilize an automatic dead lock tripper are used. The dead lock tripper automatically relock the lock when the door or other component on which the lock is mounted closes into its jamb or the like. This invention is directed to a safety mechanism for these types of locks wherein an override mechanism element is utilized to prevent the automatic locking of the lock during normal use. The override mechanism can be controlled via a secondary key.

Certain high security locks are known which include automatic dead lock trippers which relock the lock when a door or other closure means to which the lock is attached is placed from an open to a closed position. Normally, these high security locks are of the dial or combination type which do not require a key. They are utilized in certain security situations where it is desirable to prevent ingress into the high security area.

The base or body of these locks is placed on the inside of the door leading to the security area. The combination dial or the like is placed on the outside of the door with a shaft passing through the door between the dial and the base. Normally, a mechanism is included on the base which would therefore be located on the inside of the door, which allows egress from the security area. When these locks are used as manufactured, the door can only be opened from the outside by dialing the appropriate combination. As soon as the door is closed again, the automatic deadlock tripper relocks the door, such that if ingress to the security area from outside of the door is again required, once again the combination must be properly dialed. However, on the inside of the security area, since the dial is not available for unlocking the lock, a knob or the like is provided to allow persons in the high security area to exit from this area. This is necessary for safety reasons and the like wherein it is impractical to "lock someone in" from the outside.

The mechanism used on the base of the lock to allow a person to leave the security area requires certain physical dexterity to operate. In an emergency situation, those having physical handicaps of their hands, such as arthritis or missing digits or the like, are unable to manipulate these controls to open up the lock so as to be able to exit from the security area. This could impose a life threatening situation in case of fire or the like in the high security area. Further, those confined to wheelchairs or the like may not be of sufficient elevation to operate these mechanisms to open the lock and thus exit the high security area.

In other situations, it is sometimes desirable to unlock these high security locks and leave them unlocked for a period of time but to be able to easily reset the locks to prevent access to the high security area when required. Even the emergency release knobs presently forming a part of these locks do not allow normal ingress through the outside of the door during such working situations described above. Only those having knowledge of the combination of the lock are able to enter into the high security area. Since it is not desirable to carte blanche issue the combination to all those who might require access to the high security area during normal working hours, these people must continually seek assistance in order to enter the high security area. This is both time consuming with regard to interrupting other personnel as well as time consuming to the person awaiting access to the high security area.

BRIEF DESCRIPTION OF THE INVENTION

In view of the above, it is a broad object of this invention to provide a safety mechanism for a high security lock which can be set such that the lock does not automatically lock itself upon shutting of the door or other component to which the lock is mounted. It is a further object of this invention to allow overriding of the automatic relock mechanism of the high security lock in circumstances alluded to in the preceding sentence, but still allow for setting of the high security lock at other times such that the lock does automatically lock upon shutting of the door or other closure. It is a further object of this invention to provide a safety mechanism which can be added to existing locks so as to allow modification of the same in those security areas wherein these locks are already in use.

These and other objects, as will become evident from the remainder of this specification, are achieved in an improvement for a high security lock for holding a first component with respect to a second component, said lock of the type having a lock base attaching to said first component, a lock bolt, a relock means for returning said lock bolt from an unlocked position to a locked position after unlocking said lock, and a strike attaching to said second component, said lock bolt engaging said strike to lock said first component to said second component and releasing from said strike to unlock said first component from said second component which comprises: said lock base including a bolt opening, said lock bolt located in association with said opening; said bolt movably mounted on said base in association with said bolt opening so as a strike engaging portion of said bolt extends out of said bolt opening to a locked position and said strike portion of said bolt is retracted through said opening onto said base is an unlocked position; said means for returning said locked bolt from said unlocked position to said locked position comprising means mounted on said lock base for interacting with said strike when said first component is moved from an open position with respect to said second component to a closed position with respect to said second component; lock prevent means movably mounted on one of said lock bolt and said base and operatively associated with the other of said lock bolt and said base, said lock prevent means movable on said one of said lock bolt and said base on which it is mounted so as to move between a first position and a second position, said lock prevent means in said first position engaging the other of said lock bolt and said base with which it is associated so as to prevent said relock means from moving said lock bolt from said unlocked position to said locked position, said lock prevent means in said second position allowing said relock means to move said lock bolt from said unlocked position to said locked position.

In the illustrative embodiment of the invention, the lock prevention means incorporates a secondary key means which is totally independent of the primary locking mechanism for the high security lock. The key means fits into an orifice formed on the base. In the illustrative embodiment, the lock prevention means incorporates an element which is mounted on the lock bolt with a portion of the element movable back and forth with respect to the lock bolt. As illustrated, this element is a spring element with one end attached to the bolt and the other end, when the spring is in an unbiased state, positioned away from the surface of the bolt. The key means is utilized to push this other end toward the surface of the bolt to induce a bias into the spring element.

In the illustrative embodiment, the lock base would include a wall located on the base in association with the bolt opening and the lock bolt. The spring element interacts with this wall so as to hold the lock bolt in an unlocked state.

BRIEF DESCRIPTION OF THE DRAWINGS

The invention described in this specification will be better understood when taken in conjunction with the drawings wherein.

Figure 1:
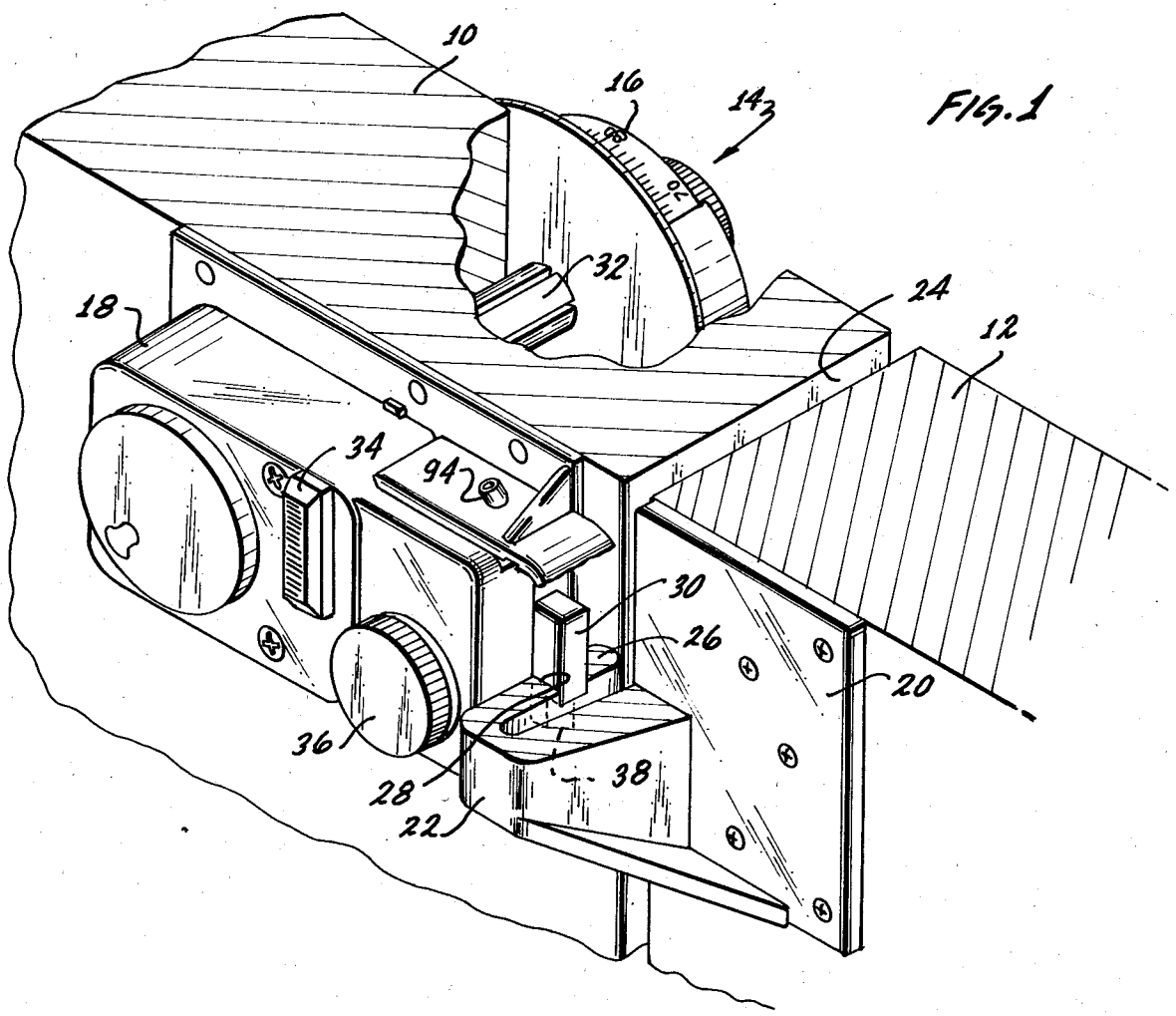
FIG. 1 is an isometric view of a door and a jamb associated with it with a high security lock which incorporates this invention therein holding the door in a locked position with respect to the jamb.

The invention illustrated in the drawings and described in this specification utilizes certain principles and/or concepts as are set forth in the claims appended to this specification. Those skilled in the locksmith arts will realize that these principles and/or concepts can be applied to a number of embodiments which might differ from the exact illustrative embodiment shown and described herein. For this reason, this invention is not to be construed as being limited solely to the illustrative embodiment, but should only be construed in view of the claims.

DETAILED DESCRIPTION OF THE INVENTION

The basic lock shown in FIG. 1 is marketed under the name SafeMasters (Trademark status unknown) by Sargent and Greenleaf, Nicklasville, KY. The lock body or its accompanying literature bear an indication to U.S. Pat. No. 2,575,674 and U.S. Pat. No. 4,163,376. It is believed that one or the other of these patents describe the primary operation of this lock. This lock is commercially available and a detailed description of the operation of the totality of the lock is not necessary to the understanding of this invention. Description will be given however to certain of the components of this lock in that their operation is necessary to the operation of the invention. Other components are shown in the drawings, however, an exact understanding of their operation will not be made as it is not pertinent to the understanding of this invention.

In FIG. 1, in section, there is shown a door 10 and a door jamb 12. The door 10 comprises a first component which is then attached to the door jamb which comprises a second component. Other components, not necessarily being doors and door jambs would also be candidates for the use of the lock 14 thereon.

The lock 14 includes a dial 16 which is located on the outside of the door 10. It further includes a base 18 located on the inside of the door 10. A strike 20 is located on the inside of the door jamb 12. A variety of different shapes of strike 20 could be utilized in conjunction with the lock 14 depending upon the configuration of the first component, i.e. the door 10 to the second component, i.e. the jamb 12, which are locked together by the lock 14. The particular strike 20 illustrated utilizes a "U" shaped member 22 which curls over the seam 24 between the door 10 and the jamb 12. The inside leg 26 of the member 22 includes an appropriate bolt receiving slot 28 which accepts the lock bolt 30 of the lock 14.

The dial 16 of the lock 14 is connected to a shaft 32 which passes through the body of the door 10. The shaft 32 in turn connects to the base 18 on the other side of the door 10. As produced, the lock 14 includes a finger lock 34 on the base 10 which allows for locking of the lock 14 from the inside of the structure, overriding opening of the structure from the dial 16. It further includes a release knob 36 which in normal instances would allow for opening of the lock 14 from the interior of the structure on which the door 10 and the jamb 14 are located.

The release knob 36 requires certain manual dexterity to operate the same. Those with arthritic fingers, missing fingers or the like, would have difficulty in rotating the release knob 36 to open the lock 14 if they desired to exit the door 10 in an emergency situation or the like.

Figure 2:
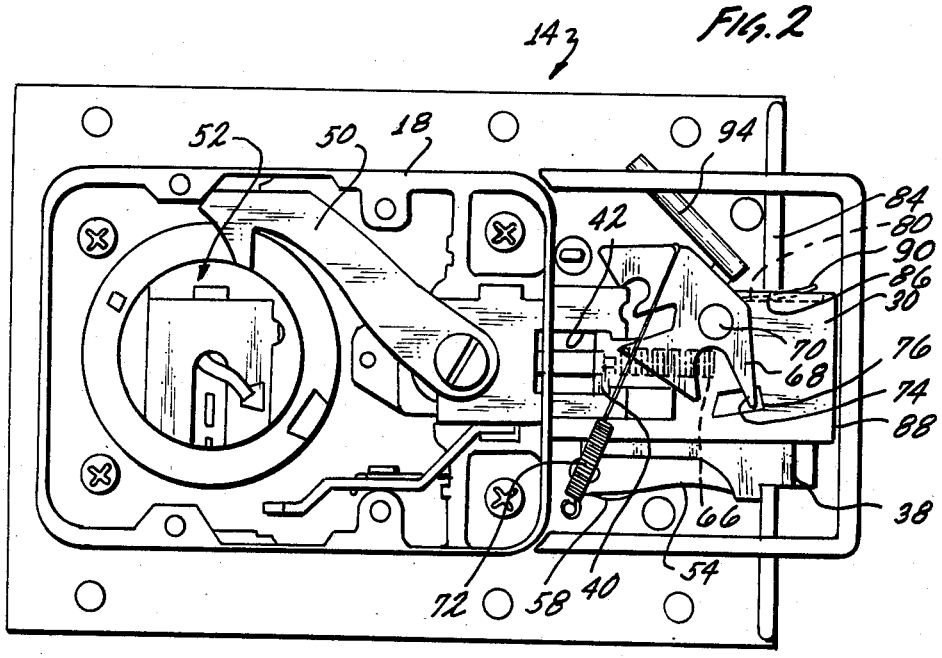
FIG. 2 is an elevational view of the high security lock shown in FIG. 1 with its rear cover plate removed so as to illustrate components located within the body of the lock.
Figure 3:
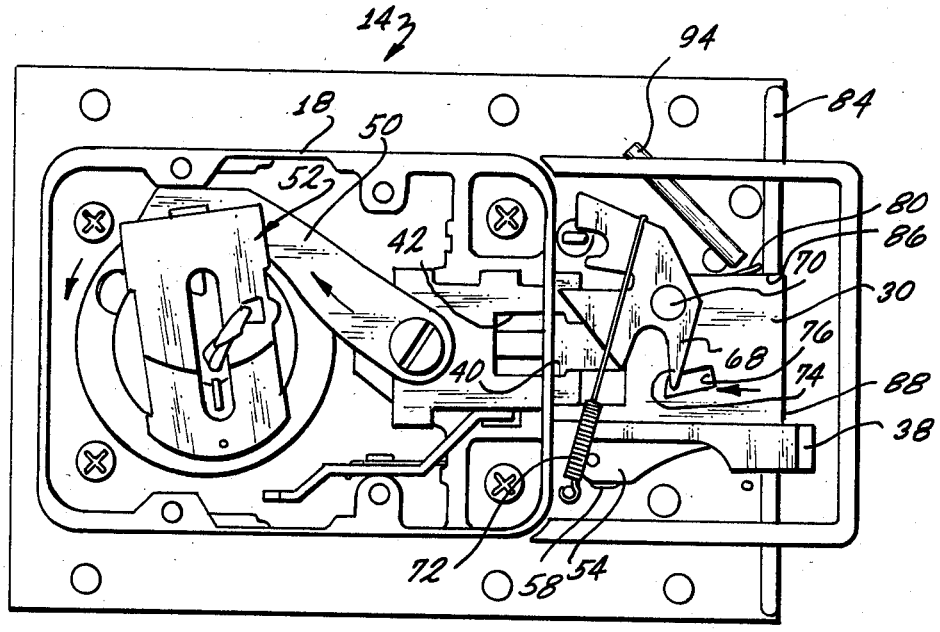
FIG. 3 is a view similar to FIG. 2 except that certain of the components of the lock have been operated thereon to reposition them in a different spatial relationship than that seen in FIG. 2.
Figure 4:
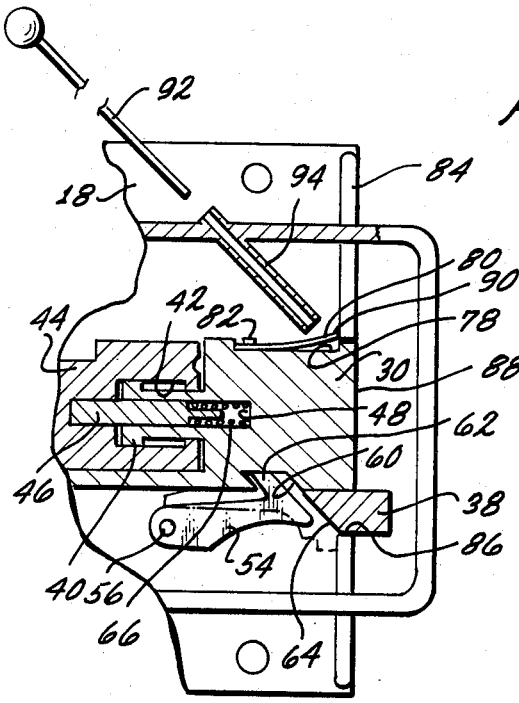
FIG. 4 is a fragmentary view of FIG. 3 in partial section.

Looking to FIGS. 2 though 6, the lock 14 also includes an automatic deadlock tripper 38 which functions as follows. When the lock 14 is open from the outside utilizing the dial 16, or open from the inside utilizing the release knob 36, the bolt 30 is retracted from the slot 28 in the strike 20. This allows opening of the door 10 with respect to the jamb 12. When the lock is open, the bolt 30 remains recessed into the base 18 as is seen in FIG. 3. Now when the door 10 is closed against the jamb 12, in closing the deadlock tripper 38 engages the strike 20 and is moved to the left by virtue of its wedge shape moving against the strike 20. When it is recessed to the left as seen in FIG. 4 it releases the bolt 30 such that as soon as the door 10 is closed, the bolt 30 immediately engages the bolt receiving slot 28 to once again lock the door 10 to the jamb 12. The lock 14 thus automatically locks itself after being open upon closing of the door 10 against the jamb 12.

Aside from the inability of certain handicapped people to operate the release knob 36, in certain instances it is desirable to open the lock 14 and leave it in an unlocked position during a normal work day or other period of time, but to insure that when it is desired for the lock 14 to be locked, that the automatic deadbolt tripper 28 functions properly to automatically lock the door 10 to the jamb 12 upon closing of the door 10 against the jamb 12.

Figure 5:
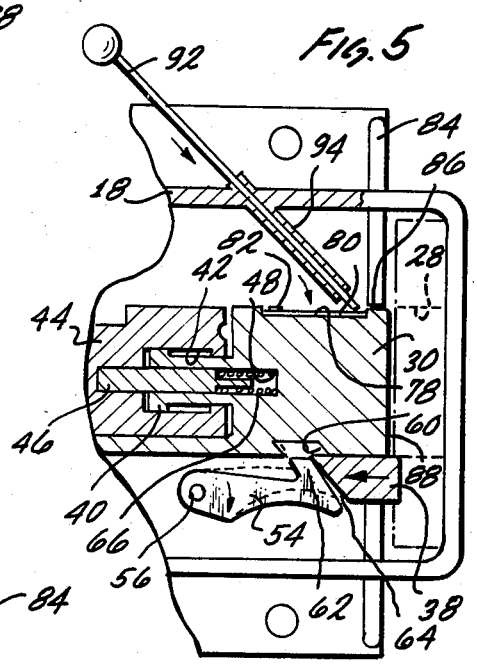
FIG. 5 is a view similar to FIG. 4 except that other components have been added and certain of the components are in a different spatial relationship than that seen in FIG. 4.
Figure 6:
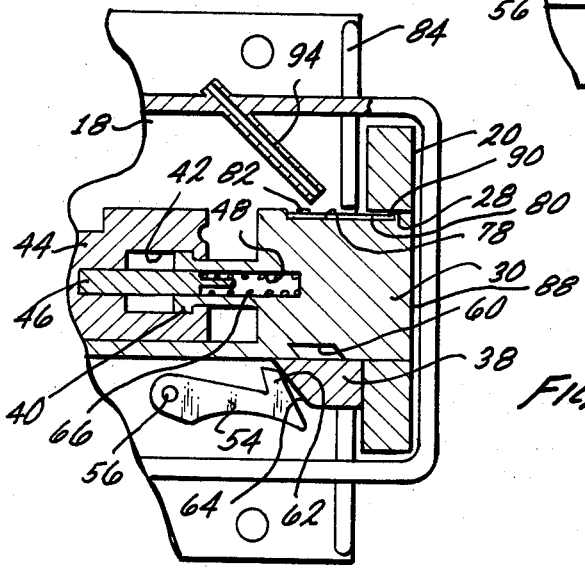
FIG. 6 is a view similar to FIGS. 4 and 5, except that certain of the components have been moved to an even further spatial relationship.

The operation of the following standard components of the lock 14 are needed prior to an understanding of the improvement of the invention. The bolt 30 includes a "T" shaped extension 40 which fits within a groove 42 of sliding member 44. A pin 46 is permanently located in sliding member 44 and extends into the center of groove 42. The pin 46 fits into a bore 48 drilled through the extension 40 and part way into the body of the bolt 30. A spring 66 fits within the bore 48 and engages the top of the pin 46 so as to bias the bolt 30 away from the sliding member 44. This allows for positioning of the bolt 30 with respect to the sliding member 44 between a completely extended position as shown in FIG. 6 with and an abutting position as shown in FIG. 4. Certain mechanisms associated with the automatic deadbolt tripper 38 as described below holds the bolt 30 in a somewhat intermediate position with respect to the sliding member 44 as seen in FIG. 5.

A lever 50 is pivoted to the sliding member 44. The lever 50 interacts with certain cams, wheels and other components not necessary to the understanding of this invention, which are generally located at the position 52 in the drawings. These are connected to the dial 16 and upon correct dialing of the combination which is incorporated into the lock 14, movement of the dial 16 is transmitted to these components so as to move the lever 50 from a right hand position seen in FIG. 2 to a left hand position as seen in FIG. 3 to retract the sliding member 44 and the bolt 30 attached thereto from the right to the left to unlock the lock 14.

A small lever 54 which is pivoted to the base 18 by a pin 56 is biased by a spring 58 upwardly. The bottom of the bolt 30 includes a notched groove 60 which accepts a tooth 62 on the end of the lever 54 when the bolt 30 is retracted or withdrawn into the base 18. The lever 54 engages the bolt 30 so as to hold the bolt 30 in an opened or unlocked position. The underside of the automatic deadlock tripper 38 includes a wedged surface 64 which engages the lever 54 to rotate the lever 54 clockwise as seen in the Figs. to withdraw the tooth 62 from the groove 60, unlatching the lever 54 from the bolt 30, allowing the bolt 30 to be pushed to the right by the compression spring 66 located in the bore 48. The spring 66 pushes against the top of the pin 46 so as to push the bolt 30 to the right with respect to the sliding member 44.

A member 68 is pivoted about a pin 70. The underside of the release knob 36 engages the member 68 to rotate it clockwise against the bias of a spring 72 associated with it. The member 68 engages the bolt 30 via finger 74 which fits into a notch 76 formed in the body of the bolt 30. This allows movement of the bolt 30 to the left under the control of the release knob 36 to open the lock.

From the inside of the door 10, the bolt 30 can be moved to the left from a locked to an unlocked position by rotating the release knob 36. This causes rotation of the member 68 clockwise to slide the bolt 30 to the left. When it is slid to the left, it is then engaged by the lever 54 to hold it in this position. From the outside of the door 10 via the dial 16 and associated parts, the bolt 30 can be drawn to the left via interaction of the lever 50 pulling on the sliding member 44 such that the sliding member 44 engages the "T" shaped extension 40 on bolt 30 to move the bolt 50 to the left from the locked to the unlocked position. The lever 54 also engages the bolt 30 when this happens to temporarily hold the bolt 30 in the open or unlocked position.

If the bolt 30 is moved to the left via the release knob 36, this compresses the compression spring 66 since the sliding member 44 is held stationary, and thus introduces a bias into it such that as soon as the lever 54 is released from the bolt 30 by deadlock tripper 38, the bolt 30 immediately moves back to the right to the locked position. If the bolt 30 is moved to the unlocked position via the dial 16, the lever 50 and the sliding member 44, it also is held in the open position by the lever 56. As soon as the dial 16 is rotated, the lever 50 pushes the sliding member 44 to the right compressing the spring 66 such that once again a bias is introduced into the same. The bolt 30, however, cannot be moved to the right to the locked position at this time since it is held by the lever 54. It only moves to the right on interaction of the deadlock tripper 38 with the lever 54 upon closing of the door 10 in the jamb 12.

From the above discussion, it is obvious that when the bolt 30 is retracted from a locked to an unlocked position both by the interaction with the dial 16 or by the release pin 36, it is only temporarily held in this unlocked position by the member 54. Immediately upon shutting of the door 10 into the door jamb 12, the deadlock tripper 38 engages the strike 20 and releases the bolt 30 from the unlocked to the locked position to engage the bolt 30 into the bolt receiving slot 28 in the strike 20. The action of the deadlock tripper 38 which serves as the relock means, is overridden as follows.

An aperture 78 formed as a rectangular groove in the top of the bolt 30 receives a spring element 80. The spring element 80 is riveted to the bolt 30 via a pin 82 on its inside end closest to the sliding member 44. The spring element 80 is formed so as to naturally have a curve in it when it is in a relaxed or unbiased states.

The spring element 80 is positioned adjacent to wall 84 which is a part of the base 18. The wall 84 is directly over the opening 86 in which the bolt passes into and out of the base 18.

The bolt 30 is retracted through the opening 86 into the base 18 either by the components associated with the dial 16 or those associated with the release knob 36 such that the end surface 88 of the bolt 30 is flush with the outside of the wall 84 as seen in FIG. 4. This insures that the bolt 30 will not bind with the strike 20 upon opening of the door 10. At this time, the lever 54 is moved upwardly into the notch 60 by the spring 58. There is a small amount of tolerance between the tooth 62 and the notched groove 60 such that upon release of the release knob 36 or rotation of the dial 16, the bolt 30 moves out a very small amount until the tooth 62 engages the edge of the notched groove 60. This positions the bolt as seen in FIG. 5 with a very small amount of the end surface 88 of the bolt 30 extending beyond the edge of the wall 84.

The spring element 80 is sized about its elongated dimension such that only when the bolt 30 is fully retracted into the base 18 with the end surface 88 flush wit the outside of the wall 84 will the spring element 80 assume its normal or unbiased state. This is seen in FIG. 4. When the bolt 30 is so positioned, the spring element 80 can assume this normal curve and its end 90 becomes locked against the wall 84. This locks the bolt 30 into the unlocked or retracted position within the base 18 with the end surface 88 of the bolt 30 flush with the outside surface of the wall 84.

If the door 10 is now closed, even though the deadlock tripper 38 upon interaction with the strike 20 moves to the left upon closing of the and even though the lever 54 is released from the notched groove 60, the bolt 30 is prevented from moving to the right from the unlocked to the locked position by the interaction of the spring element 80 against the wall 84. Not until the end 90 of the element 80 is depressed such that it is recessed into the aperture 78 will the bolt 30 be able to move to the right to the locked position.

This is accomplished by inserting a secondary key 92 into a tube 94 which serves as a channel or orifice for the same such that the end of the key 92 can press against the end of the spring element 80 depressing the spring element 80 totally into its aperture 78 and in doing so, introducing a bias into the spring element 80.

This allows the bolt 30 to slip to the right, either fully to the unlocked position, or until it is held in the position seen in FIG. 5 by the lever 54 as it is shown in phantom line in FIG. 5. Now when the door 10 is closed, the deadlock tripper 38 will interact with the lever 54 to release the lever 54 to the position shown in slid line in FIG. 5, allowing the bolt 30 to continue its movement to the right from the unlocked to the locked position.

As can be seen in FIG. 6, when in the locked position, the spring element 80 is held down in its aperture 78 by the wall 84 and the bolt receiving slot 28 in the strike 20.

Any time it is desirous for the automatic lock tripper 38 to relock the bolt 30, the key 92 is simply inserted through the tube 94 to depress the end 90 of the spring element 80 such that it catches underneath the end of the wall 84 with the bolt 30 then not being held by the spring element 84 but being held by the lever 54. Any time it is desirous to retain the bolt 30 in the unlocked position, the bolt 30 is withdrawn into the base 18 either by the dial 16 or by the release knob 36 totally such that the end 90 of the spring element 80 clears the inside edge of the wall 84 and flips up into its relaxed, or unbiased, position to lock against the inside of the wall 84.

While the spring element 80, a lock preventive means, is shown in the illustrative embodiment as attached to the bolt 30 and interacting with the wall 84 of the base 18, it is evident that other embodiments could easily be constructed wherein a lock preventive means could attach to the base 18 and interact with the bolt 30.

I claim:

1. In combination with a high security lock, said lock for locking a first component to a second component, said lock having a lock base attaching to said first component, a lock bolt, a primary unlocking mechanism for moving said lock bolt from a locked position to an unlocked position, a relock means for returning said lock bolt from said unlocked position to said locked position after unlocking said lock, and a strike attaching to said second component, said lock bolt engaging said strike to lock said first component to said second component and releasing from said strike to unlock said first component from said second component, wherein the improvement comprises:

said lock base including a bolt opening, said lock bolt located in association with said opening;

said bolt movably mounted on said base in association with said bolt opening so as a strike engaging portion of said bolt extends out of said bolt opening to a locked position and said strike portion of said bolt is retracted through said opening onto said base in an unlocked position;

said means for returning said locked bolt from said unlocked position to said locked position comprising means mounted on said lock base for interacting with said strike when said first component is moved from an open position with respect to said second component to a closed position with respect to said second component;

lock prevent means movably mounted on one of said lock bolt and said base and operatively associated with the other of said lock bolt and said base, said lock prevent means movable on said one of said lock bolt and said base on which it is mounted so as to move between a first position and a second position, said lock prevent means in said first position engaging the other of said lock bolt and said base with which it is associated so as to prevent said relock means from moving said lock bolt from said unlocked position to said locked position, said lock prevent means in said second position allowing said relock means to move said lock bolt from said unlocked position to said locked position.

2. The improvement of claim 1 wherein:

said lock prevention means includes secondary key means which is independent from the primary unlocking mechanism of said high security lock, said secondary key for moving said lock prevent means from said first position to said second position.

3. The improvement of claim 1 wherein:

said lock base includes a wall located on said base in association with said bolt opening and said lock bolt, said strike engaging portion of said bolt moving with respect to said wall as said lock bolt extends and retracts through said opening;

said lock prevent means interacting with said wall to maintain said lock bolt in said unlocked position.

4. The improvement of claim 3 wherein:

said lock prevent means is mounted on said lock bolt in a position so as to interact with said wall.

5. The improvement of claim 4 wherein:

said prevent means comprises an element mounted in said lock bolt and including at least a portion of said element movable between a wall engaging position and a non-engaging position, said position of said element engageable with said wall in said engaging position so as to lock said lock bolt in said unlocked position.

6. The improvement of claim 5 wherein:

said element is a spring element having ends and is attached to said lock bolt at one of its ends, the other of said ends movably positionable away from said lock bolt when said spring element is in an unbiased state, the other of said ends positionable adjacent to said bolt in an abutting relationship to create a bias in said spring element.

7. The improvement of claim 6 wherein:

said lock prevention means includes secondary key means which is independent from the primary unlocking mechanism of said high security lock, said secondary key for moving said lock prevent means from said first position to said second position.

8. The improvement of claim 7 further including:

said secondary key means comprising an elongated key element;

said base including a secondary key orifice positioned in association with said spring element, said elongated key element positionable in said orifice so as to contact the other of said ends of said spring element so as to position the other of said ends adjacent to said lock bolt.

9. The improvement of claim 8 wherein:

said bolt element includes a spring aperture sized and shaped so as to contain said spring element when said other end of said spring element is positioned adjacent to said lock bolt.

* * * * *

UNITED STATES PATENT AND TRADEMARK OFFICE

CERTIFICATE OF CORRECTION

PATENT NO. : 4,601,504

DATED : July 22, 1986

INVENTOR(S) : RALPH WOLF

It is certified that error appears in the above-identified patent and that said Letters Patent is hereby corrected as shown below:

Column 1, line 8, "relock" should be --relocks--.

Column 4, line 39, "open" should be --opened--.

Column 4, line 40, "open" should be --opened--.

Column 5, line 8, delete the word "with".

Column 5, line 60, change the numeral "50" to --30--.

Column 6, line 29, "states" should be --state--.

Column 6, line 52, "wit" should be --with--.

Column 6, line 63, delete the words "of the".

Column 7, line 14, "slid" should be --solid--.

UNITED STATES PATENT AND TRADEMARK OFFICE

CERTIFICATE OF CORRECTION

PATENT NO. : 4,601,504

DATED : July 22, 1986

INVENTOR(S) : RALPH WOLF

It is certified that error appears in the above-identified patent and that said Letters Patent is hereby corrected as shown below:

Column 8, line 36, the last occurrence of the word "position" should read --portion--.

Signed and Sealed this

Twenty-seventh Day of January, 1987

*Attest:*

DONALD J. QUIGG

*Attesting Officer* *Commissioner of Patents and Trademarks*